United States Patent [19]

Appelberg

[11] Patent Number: 4,856,392

[45] Date of Patent: Aug. 15, 1989

[54] APPARATUS AND METHOD FOR CUTTING MULTIPLE LAMP OUTLINES FROM ELECTROLUMINESCENT STRIP

[75] Inventor: Gustaf T. Appelberg, Fairfield, Conn.

[73] Assignee: E-Lite Technologies, Inc., Watertown, Conn.

[21] Appl. No.: 118,758

[22] Filed: Nov. 9, 1987

[51] Int. Cl.[4] ..... B26D 5/20; B26D 9/00

[52] U.S. Cl. ..... 83/40; 83/50; 83/862; 83/256; 83/865; 83/42

[58] Field of Search ..... 83/256, 35, 40, 48, 83/50, 404.2, 862, 865, 42

[56] References Cited

U.S. PATENT DOCUMENTS

| | | | |
|---|---|---|---|
| 3,232,155 | 2/1966 | Davis | 83/50 X |
| 3,316,811 | 5/1967 | Friedman et al. | 83/862 |
| 3,688,619 | 9/1972 | Yabuta | 83/256 X |
| 4,043,231 | 8/1977 | Friedberg | 83/865 X |
| 4,341,135 | 7/1982 | Ufermann et al. | 83/256 X |
| 4,641,555 | 2/1987 | Johnson et al. | 83/256 X |

*Primary Examiner*—Donald R. Schran

*Attorney, Agent, or Firm*—McCormick, Paulding & Huber

[57] ABSTRACT

The invention involves moving a strip of electroluminescent material past a shear in successive increments each equal to the length of a lamp outline to be cut from the strip. The shear is actuated after each incremental advance to cut a blank having a first dimension equal to the desired length of the lamp outline and a second dimension equal to the strip width, which is a multiple of the desired width of the lamp outline. The blank is then advanced past a punch and die in successive increments equal to the width of the lamp outline to be cut. The punch is actuated after each incremental advance to cut across or transverse to the second dimension to form lamp outlines having the desired length and width. The punch and die are configured to simultaneously cut a straight side of a lamp outline advanced past the punch and a straight side having a projecting electrical tab of an adjacent lamp outline behind the punch. A lamp outline is thus cut by first and second incremental advances with the punch actuated after each incremental advance.

7 Claims, 3 Drawing Sheets

APPARATUS AND METHOD FOR CUTTING MULTIPLE LAMP OUTLINES FROM ELECTROLUMINESCENT STRIP

FIELD OF THE INVENTION

The invention relates to an apparatus and method for cutting articles from strip or sheet material and, in particular, for die cutting lamp outlines from electroluminescent sheet.

BACKGROUND OF THE INVENTION

Copending U.S. patent application Ser. No. 054,532 filed May 27, 1987 entitled "Method For Making Multiple Electroluminescent Panel Lamps With Integral Electrical Connectors", of common inventorship and assignee herewith, discloses a method for making multiple electroluminescent panel lamps wherein a thin electroluminescent strip is formed by deposition of various materials onto the strip and then cutting outlines of lamps from the electroluminescent strip using a punch and die or cutting tool.

U.S. Pat. No. 4,534,743 issued Aug. 13, 1985, to Anthony D'Onofrio and Walter Kitik describes a method for making an electroluminescent strip. The strip is cut to length and flexible electrical connectors are attached to opposite sides of the cut strip.

SUMMARY OF THE INVENTION

The invention contemplates an apparatus for cutting multiple articles, such as lamp outlines, from a strip or sheet of material, such as a strip of electroluminescent material.

The invention also contemplates a method for cutting multiple articles, such as lamp outlines, from a strip or sheet of material, such as a strip of electroluminescent material.

In a typical working embodiment of the invention, the strip of material has a strip length that is a multiple of the selected length of the article to be cut and a strip or coil width from which multiples of the selected width of the articles are cut. The apparatus includes strip cutting means toward which the strip is advanced in successive increments each substantially equal to the selected length of the article to be cut and first actuating means for actuating the strip cutting means after each increment of movement of the strip to cut the strip into a blank having a first dimension equal to the selected length of the article to be cut and a second dimension equal to the strip or coil width. Blank advancing means moves the sheared blank toward blank cutting means in a direction parallel to the second dimension in successive increments with each increment substantially equal to the selected width of the article to be cut. Second actuating means actuates the blank cutting means after each increment of movement of the blank to cut the blank across or transverse to the second dimension into articles having the desired length and width.

In a preferred embodiment for cutting electroluminescent lamp outlines, the blank cutting means includes a cutting edge that simultaneously cuts a straight edge on an article outline advanced ahead of the cutting edge and a straight edge with a projecting electrical connector tab on an adjacent article outline behind the cutting edge.

In another preferred embodiment, the blank cutting means includes means for cutting a groove in the blank as it is advanced toward the blank cutting means.

In a typical working embodiment of the method of the invention, the method involves moving the strip toward the strip cutting means in successive increments each substantially equal to the selected length of the article to be cut, cutting the strip after an increment of movement to cut a blank from the strip, moving the blank toward blank cutting means in a direction parallel with the second dimension in successive increments each substantially equal to the selected width of the article to be cut and cutting the blank after each increment of movement thereof to form articles having the selected length and width. The article is thus cut from the blank by successive relative incremental advances of the blank and the blank cutting means with the latter actuated after each incremental advance. Once the blank is cut to yield all articles that it can, another blank is cut from the strip after it is relatively incrementally advanced past the strip cutting means and the blank advancing and cutting steps are repeated.

BEST MODE FOR PRACTICING THE INVENTION

Figure 1:
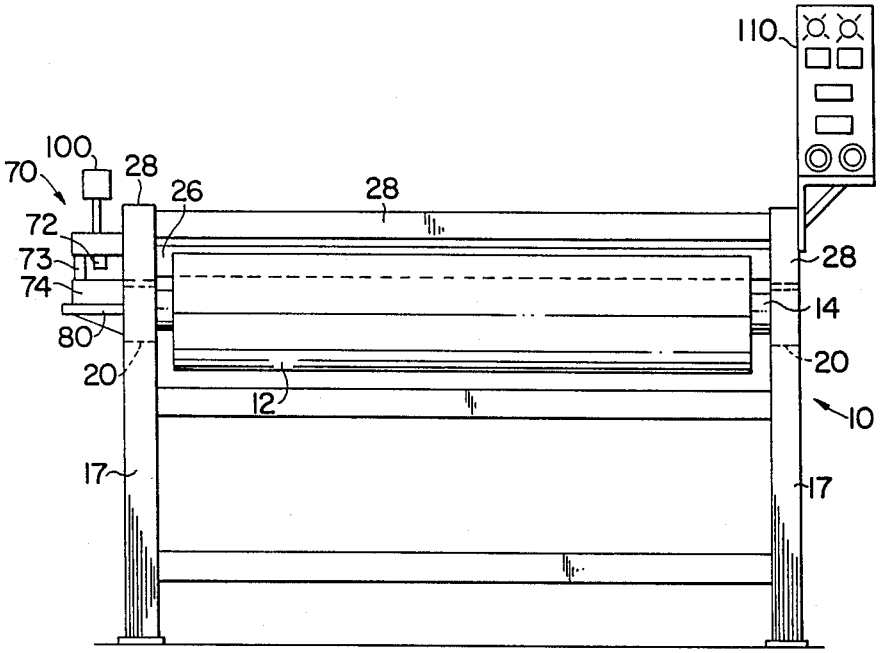
FIG. 1 is a front elevation of the invention with some components shown schematically.

The apparatus of the invention is shown in FIGS. 1–4 as including a support frame or base 10. Adjacent one end of the frame is a coil 12 of thin electroluminescent strip or sheet that is made in accordance with the teachings of copending U.S. application Ser. No. 940,794 filed Dec. 12, 1986, "Method For Manufacturing An Electroluminescent Lamp As Well As Panel Lamp Produced Thereby" and aforementioned copending U.S. application Ser. No. 054,532, both of common inventorship and assignee herewith, the teachings of both of which are incorporated herein by reference. Briefly, the electroluminescent strip or sheet of coil 12 includes a plastic carrier strip 2 having a first electrode 3 thereon, an electroluminescent layer 4 deposited on the first electrode and a vapor deposited or foil metallic layer 5 deposited or adhered on the electroluminescent layer as a second electrode, see FIGS. 6 and 7.

Coil 12 may have an uncoiled length of 500 to 1000 feet and a width of 24 to 60 inches. The thickness of the strip is about 0.008 inch.

Coil 12 is freely rotatably mounted on a shaft 14 extending between and rotatably mounted on side frame members 16 which are supported by vertical posts 17. Opposite ends of the shaft 14 are inserted in anti-friction bearing assemblies 20 on the frame members 16.

Figure 2:
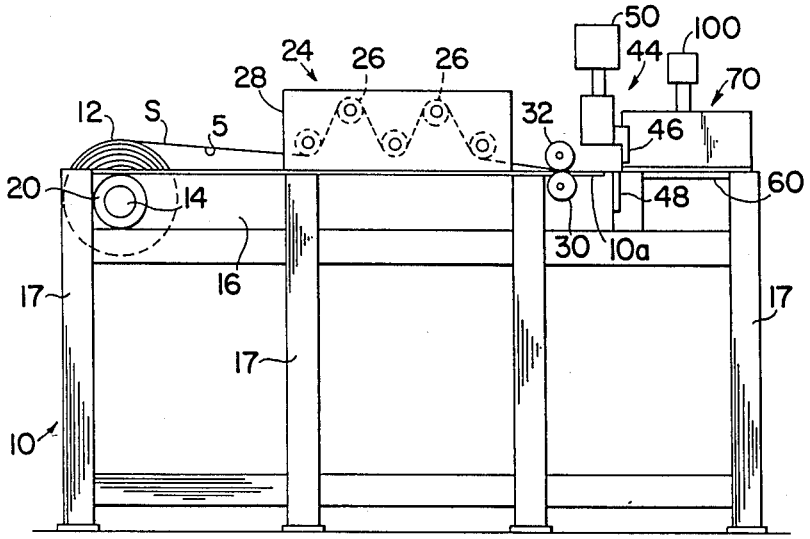
FIG. 2 is a side elevation of the machine of FIG. 1.
Figure 3:
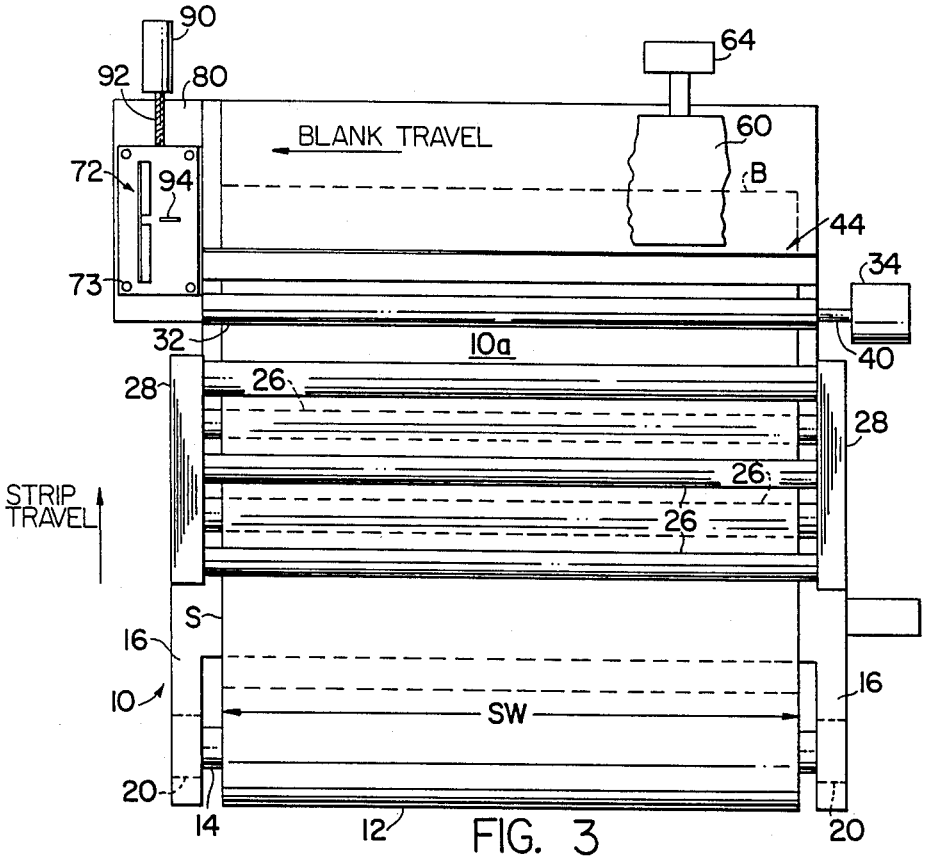
FIG. 3 is a top elevation of the machine of FIG. 1.

As shown best in FIG. 2, the strip S of coil 12 is fed or payed-off first to a strip straightener 24 comprising multiple staggered freely rotatable rolls 26 in housing 28. Strip S is payed-off the coil 12 with the vapor deposited or foil metallic electrode layer 5 facing downward toward table 10*a* of base 10.

From the coil straightener 24 the strip S is fed between a pair of opposed drive rolls 30,32, one or both of which is a strip advancing or drive roll. Roll 30 is driven in rotation by a suitable drive motor 34 such as a conventional electric motor, through a drive shaft 40. The other roll 32 may be similarly driven. The spacing between rolls 30,32 is such as to effect driving engagement with the strip S therebetween so that the strip can be advanced to the right in FIG. 2 in the direction of the strip length or long axis of the strip when drive roll 30 is rotated a explained below.

Downstream of the rolls 30,32 is strip cutting means in the form of a shear 44 having moving shear blade or cutting edge 46 and stationary blade or cutting edge 48. The moving shear blade 46 is caused to move downwardly in FIG. 2 toward and in shearing cooperation with fixed shear blade 48 by a suitable actuator 50 such as a pneumatic actuator. Actuator 50 and moving blade 46 can be mounted from the base frame 10 or they can be mounted independently of the base frame on the same or separate support structure (not shown).

As shown in the figures, the shear 44 extends across the strip S perpendicular to the strip long axis and its direction of movement on the table 10*a* of frame or base 10 .

As will be explained hereinbelow, the strip S is fed by rolls 30,32 past shear 44 in successive increments each equal substantially to the length L of the lamp outline P to be cut, FIGS. 5 and 6. The shear is actuated to cut the strip S into a blank B having as its first short dimension the length L of the lamp outline to be cut and as its second long dimension the width SW of strip S.

Downstream of the shear 44 is a blank advancing or moving endless belt 60 on which the blank B rests after it is cut from strip S by shear 44. Belt 60 is caused to move in a direction perpendicular to the direction of strip movement toward shear 44 by a suitable belt actuator 64, such as a controlled pulse D. C. electrical motor. Belt 60 advances the blank B toward blank cutting means 70 in a direction parallel to the second long dimension in successive increments each substantially equal to the selected width W of the lamp outline P, FIGS. 5 and 6, for purposes to be explained.

Figure 4:
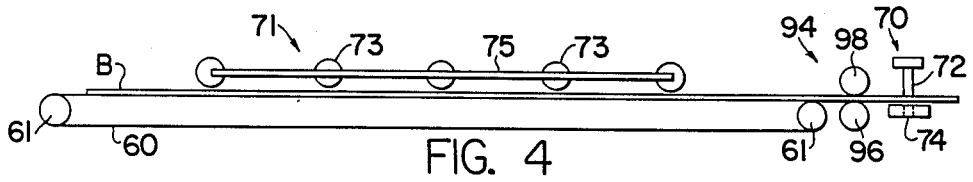
FIG. 4 is a rear elevation of certain components of the machine of FIG. 1 to show the endless belt, milling cutter and punch/die.

A pressure roll assembly 71 is shown lowered in position in FIG. 4 to bear on blank B after it has been cut and drops onto belt 60 to aid belt 60 in accurately advancing the blank to cutting means 70. Belt 60 is driven on suitable rollers 61. The pressure roll assembly includes idler rolls 73 to engage the upper surface or side of the cut blank. Frame 75 can be raised out of the way during shearing of the blank B to allow the blank to fall onto the belt 60. Thereafter, the pressure roll assembly is lowered onto the blank. Suitable known mechanisms can be employed to raise and lower the assembly 71. The assembly 71 can also be hingedly mounted to open and close to this same end.

Blank cutting means 70 includes a punch 72 carried on and movable with a die 74. Die 74 is movable on plate 80 attached to base 10 perpendicular to the direction of blank travel by means of servo-motor 90 and associated drive screw 92 connected drivingly to the die 74.

A blank grooving device 94 is also carried on and movable with die 74 for purposes to be explained.

Figure 5:
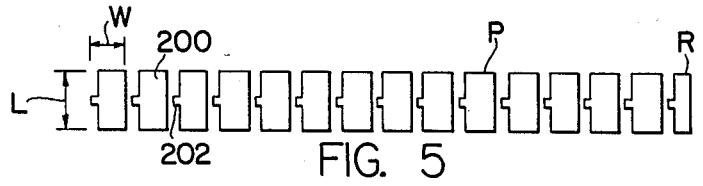
FIG. 5 is a plan view of multiple lamp outlines cut from the blank of the strip material.

After the blank B is advanced in each aforesaid successive increments toward blank cutting means 70, the punch 72 is actuated by actuator 100, such as a pneumatic actuator, to cut in cooperation with die 74 across the blank across or transverse to its second long dimension to produce in successive manner a plurality of lamp outlines P shown in FIG. 5 which are collected in a suitable receptacle (not shown). Punch 72 is guided in its movement on guide pins 73 extending between punch 72 and die 74 and mounted on the latter.

Advancement of blank B in successive increments toward blank cutting means 70 and actuation of the punch 72 after each incremetal advance of the blank are coordinated and controlled by computer control unit 110. In particular, the selected length of the lamp outline L is input or programmed into the control unit. The selected width W of the lamp outline and the number of lamp outlines are also input or programmed into the control unit. Thereafter, the control unit 110 will automatically control incremental advance of the strip S past shear 44 and actuation of shear blade 46 as well as advance of blank B past blank cutting means 70 and actuation of the blank cutting means 70 until the number of lamp outlines input are cut.

Servo-motor 90 is controlled by control unit 110 to move the carriage 80 in desired position to center the punch and die 72,74 and grooving device 94 relative to the length dimension L of the lamp outline. Carriage 80 is thus moved in a direction parallel with length L of the blank B.

Figure 6:
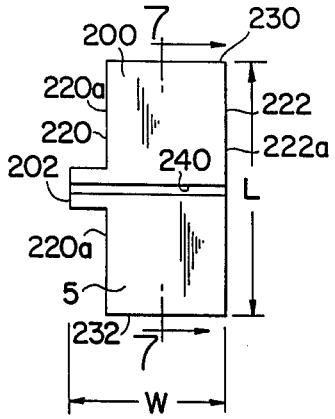
FIG. 6 is a plan view of a lamp outline cut from the blank.
Figure 7:
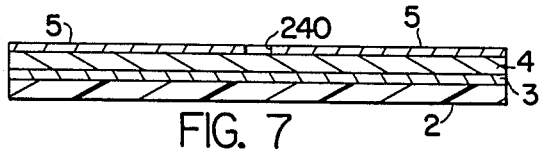
FIG. 7 is section view of the lamp of FIG. 6.

FIG. 6 shows a typical lamp outline P to be cut by the apparatus described above from strip S. Lamp outline P includes a main body 200 rectangular in plan and an electrical connector tab 202 projecting integrally from the body 200. The lamp outline includes first and second major sides 220,222 having the selected length L and first and second minor sides 230,232 having the selected width W that includes the width dimension of the tab 202. Major side 220 (first side) includes a straight edge 220*a* and connector tab 202 projecting from edge 220*a*. Major side 222 (second side) has straight edge 222*a* only. Lamp outlines having these features are described in copending U.S. application Ser. No. 054,532 filed May 27, 1987, "Method For Making Multiple Electroluminescent Panel Lamps With Integral Connectors", of common inventorship and assignee herewith. The minor sides 230,232 are straight edges as shown. The invention is not limited to cutting only straight-sided outlines, however.

When the lamp to be cut is of the split electrode type described in the aforesaid copending U.S. application Ser. No. 940,794, a groove 240 is provided on one of the electrodes of the lamp. For example, groove 240 can be provided through the second vapor deposited or adhered foil metallic layer 250 on the strip S.

From what has been described above, it is apparent that minor sides 230,232 are formed on blank B by shear 44 cutting the strip S after it is advanced past the shear an increment corresponding to the selected length of the lamp outline. And, major sides 220,222 are then formed by punch and die 72,74 cutting the blank B after it is advanced past punch and die 72,74 an increment corresponding to the selected width of the lamp outline. Thus, two successive incremental advances of blank B and actuation of punch 72 after each incremental advance produces the lamp outline P.

Figure 8:
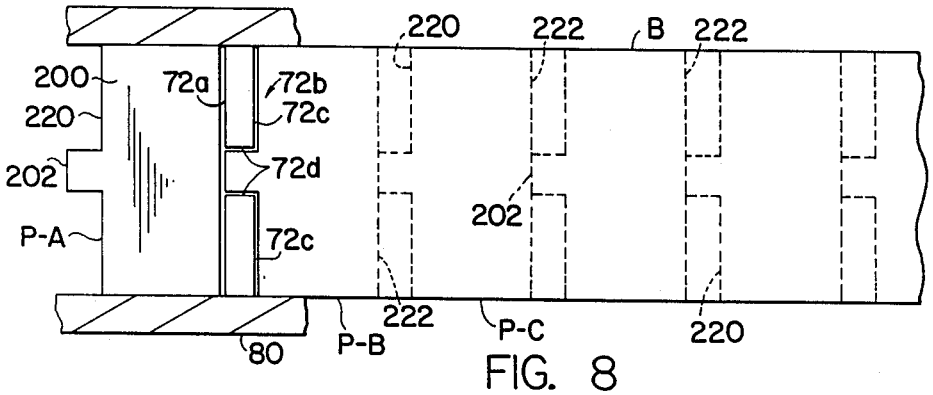
FIG. 8 is a plan view of a length of the blank at the blank cutting punch and die with lamp outlines to be cut superimposed on the blank.

Referring to FIG. 8, lamp outlines P to be cut are superimposed over a section of blank B positioned at blank cutting means 70. Punch 72 is shown including a first straight cutting edge 72*a* and a second cutting edge 72*b* having edge portions 72*c* and 72*d*. Of course, die 74 has complementary die surfaces to cooperate with cutting edges 72*a* and 72*b* to cut the blank.

When the punch is actuated to move toward the blank B, the cutting edge 72*a* cuts the second major side 222 of the lamp outline P-A advanced ahead or past that cutting edge whereas cutting edge 72*b* cuts the first major side 220 of the adjacent lamp outline P-B located behind or upstream of cutting edge 72*a*. When the blank B is advanced an increment to place lamp outline P-B ahead of cutting edge 72*a* with another lamp outline P-C in the former position of lamp outline P-B and the punch is actuated, it is clear that cutting edge 72*a* now cuts the second major side 222 of lamp outline P-B and first major side 220 of lamp outline P-C. Lamp outline P-B is thus fully cut from blank B by successive incremental advance of the blank and actuation of punch 74 after each incremental advance. This sequence is repeated until the blank B yields all lamp outlines P that it can and any scrap outline R.

After blank B is completely cut, drive rolls 30,32 are actuated to advance step S past shear 44 an increment equal to the selected length L of the lamp outline to be cut, and the shear is actuated to provide another blank for successive incremental advance and cutting by blank cutting means 70. The sequence of strip cutting to form a blank B and blank cutting to form lamp outlines P is repeated until the quantity of lamp outlines input into control unit 110 is satisfied.

If lamp outlines having a length and width different from those previously cut are desired, the new length and width can be input to control unit 110. Control unit 110 will then control drive rolls 30,32 to advance strip S in successive increments each substantially equal to the new length desired and control the actuator 62 for drive belt 60 to advance blank B in successive increments each substantially equal to the new width of the lamp outline. Punch and die 72,74 are centered relative to the new length by servo-motor 90. Servo-motor 90 moves the punch and die the necessary distance in a direction parallel to the length L equal to 50% of the difference between the old length L and new length L of the lamp outline. Unless the punch and die are changed, the lamp outlines having the new length and width will have the same size and shape connector tab 202. It is preferred to use the same size and shape of tab 202 so that a universal electrical connector can be used with all lamp outlines; e.g. see the aforementioned copending U.S. application Ser. No. *054,532*.

Groove 240 shown in FIG. 6 can be formed on the blank B and resultant lamp outline by the grooving device 94 as the blank is incrementally advanced past the blank cutting means 70. Grooving device 94 includes a rotatable milling cutter 96 driven by a conventional electric motor (not shown) and a pressure roller 98 in rolling contact with the opposite side of blank B as shown. The milling cutter and roller have rotational axes perpendicular to the direction of blank travel toward the punch and die and are centered relative tab 202 and body 200 to cut the groove in layer 5 as the blank is incrementally advanced.

Those skilled in the art will appreciate that the apparatus and method of the invention can be used to cut articles other than lamp outlines from strip material other than electroluminescent strip. And, while there have been described in the foregoing specification the preferred embodiments for carrying out the invention, it is my intent to cover in the appended claims all modifications thereof as fall within the spirit and scope of the invention as set forth in the appended claims.

I claim:

1. A method for cutting multiple lamp outlines each having opposite first and second major sides of selected length with said first side being a straight edge having a tab projecting therefrom and said second side being a straight edge and having opposite first and second straight minor sides of selected width from an electroluminescent strip having a strip length that is a multiple of said selected length and a strip width that is a multiple of said selected width, comprising:

(a) moving the strip along the strip length toward strip cutting means in increments substantially equal to said selected length, (b) cutting the strip after an increment of movement to cut the strip into a rectangular blank having a first dimension equal to the selected length of the lamp outline and a second dimension equal to multiples of the selected width of the lamp outline;

(c) moving the blank toward the blank cutting means in the direction of the second dimension in increments substantially equal to said selected width of the lamp outline and forming a groove along one surface of the blank in a direction substantially parallel to said minor sides and extending substantially the entire width of the blank and substantially midway between said minor sides as said blank is advanced toward the blank cutting means, (d) cutting the blank with the blank cutting means after each increment of movement to cut the second major side of a lamp outline advanced ahead of the blank cutting means as a straight edge and the first major side of an adjacent lamp outline behind the blank cutting means as a straight edge having a tab projecting therefrom, whereby the blank is cut into lamp outlines having said selected length and width as the blank is incrementally advanced past the blank cutting means.

2. The method of claim 1 including repeating steps (a) and (b) after step (d) to provide another blank for steps (c) and (d).

3. Apparatus for cutting multiple articles each having opposite first and second major sides of selected length and opposite first and second minor sides of selected width from a strip length that is a multiple of said selected length and a strip width that is a multiple of said selected width, comprising:

strip cutting means;

strip advancing means moving the strip toward said strip cutting means in increments substantially equal to said selected length;

first actuating means for actuating said strip cutting means after each increment of movement of the strip to cut the strip into a blank having a first dimension equal to said selected length of the article and a second dimension equal to the strip width;

blank cutting means having a cutting edge and said blank cutting means further including means for cutting a groove in the blank;

blank advancing means for moving the blank toward said blank cutting means in increments substantially equal to said selected width of the article, and second actuating means for actuating the cutting edge of said blank cutting means after each increment of movement of the blank toward said blank cutting means to cut across the second dimension to cut the second major side of an article advanced ahead of the cutting edge and the first major side of an adjacent article behind the cutting edge, whereby the blank is cut into articles having said selected length and width as the blank is incrementally advanced past the selected cutting edge;

said blank cutting means being movable in an direction transverse to the direction of movement of the blank to adjust the position of said blank cutting means relative to the length dimension of a lamp outline cut from the blank.

4. The apparatus of claim 3 wherein the strip advancing means includes a strip drive roller to move the strip toward the shear means in a direction orthogonal thereto.

5. The apparatus of claim 3 wherein the blank advancing means includes a blank drive belt on which the blank is disposed to move the blank toward the blank cutting means.

6. The apparatus of claim 3 further including coil support means for rotatably supporting a coil of the strip and from which coil the strip is fed incrementally to the strip cutting means by the strip advancing means.

7. Apparatus for cutting multiple articles each having opposite first and second major sides of selected length and opposite first and second minor sides of selected width from a strip having a strip length that is multiple of said selected length and a strip width that is multiple of said selected width, comprising:

strip cutting means;

strip advancing means for moving the strip toward said strip cutting means in increments substantially equal to said selected length;

first actuating means for actuating said strip cutting means after each increment of movement of the strip to cut the strip into a blank having a first dimension equal to said selected length of the article and a second dimension equal to the strip width;

blank cutting means having a cutting edge and said blank cutting means further including means for cutting a groove in the blank;

blank advancing means for moving the blank toward the blank cutting means in increments substantially equal to said selected width of the article, and second actuating means for actuating the cutting edge of the blank cutting means after each increment of movement of the blank toward the blank cutting means to cut across the second dimension to cut the second major side of an article advanced ahead of the cutting edge and the first major side of an adjacent article behind the cutting edge, whereby the blank is cut into articles having said selected length and width as the blank is incrementally advanced past the actuated cutting edge;

said blank cutting means further comprising a punch and die having a straight cutting edge portion to cut the second major side of the article ahead of the cutting edge as a straight side and another cutting edge portion configured to cut the first major side of the article behind the cutting edge as a straight side with a tab projecting therefrom;

said blank cutting means being movable in a direction transverse to the direction of movement of the blank to adjust the position of said blank cutting means relative to the length dimension of a lamp outline cut free from the blank.

* * * * *